US011235381B2

(12) United States Patent
Heikaus

(10) Patent No.: US 11,235,381 B2
(45) Date of Patent: Feb. 1, 2022

(54) POURING NOZZLE WITH A REPLACEABLE CROWN

(71) Applicant: EKW GMBH, Eisenberg (DE)

(72) Inventor: Thomas Heikaus, Frankfurt (DE)

(73) Assignee: EKW GMBH, Eisenberg (DE)

( * ) Notice: Subject to any disclaimer, the term of this patent is extended or adjusted under 35 U.S.C. 154(b) by 0 days.

(21) Appl. No.: 16/610,122

(22) PCT Filed: Apr. 30, 2018

(86) PCT No.: PCT/EP2018/061042
§ 371 (c)(1),
(2) Date: Nov. 1, 2019

(87) PCT Pub. No.: WO2018/202626
PCT Pub. Date: Nov. 8, 2018

(65) Prior Publication Data

US 2020/0086382 A1 Mar. 19, 2020

(30) Foreign Application Priority Data

May 3, 2017 (DE) ..... 10 2017 109 448.2

(51) Int. Cl.
*B22D 17/20* (2006.01)
*B22D 18/04* (2006.01)
*B22D 41/50* (2006.01)

(52) U.S. Cl.
CPC ..... *B22D 17/2023* (2013.01); *B22D 18/04* (2013.01); *B22D 41/50* (2013.01)

(58) Field of Classification Search
CPC .... B22D 17/2023; B22D 18/02; B22D 18/04; B22D 35/04; B22D 41/00; B22D 41/50
USPC ..... 222/591, 594, 606, 607; 266/236, 275, 266/276; 164/306, 119, 308, 309, 437, 164/335, 63
See application file for complete search history.

(56) References Cited

U.S. PATENT DOCUMENTS 3,163,897 A * 1/1965 Sylvester ..... B22D 41/48 164/119
5,180,538 A * 1/1993 Vatant ..... B22D 41/12 266/91

(Continued)

FOREIGN PATENT DOCUMENTS

DE 19906982 A1 8/2000
EP 0215153 A1 3/1987

OTHER PUBLICATIONS

International Search Report, PCT/EP2018/061042, dated Sep. 12, 2018, 2 pages.

*Primary Examiner* — Scott R Kastler
*Assistant Examiner* — Michael Aboagye
(74) *Attorney, Agent, or Firm* — Stinson LLP

(57) ABSTRACT

A casting nozzle for guiding a melt from an outlet of a casting furnace into a casting box, the casting nozzle comprising a main body; a crown attached to the main body; a guiding channel through the main body and crown; a stub on the main body, which stub has a front side that is insertable into a casting furnace outlet and into which the guiding channel enters; a flange on the stub on a side opposite to the front side for applying onto the casting furnace; and a crown socket that is formed at the flange opposite to the stub for carrying the crown. The casting nozzle in combination with a casting furnace and a casting box.

16 Claims, 2 Drawing Sheets

(56) References Cited

U.S. PATENT DOCUMENTS 5,919,392 A * 7/1999 Myers ..... B22D 41/50
222/606
6,216,766 B1 * 4/2001 Benni ..... B21F 27/125
164/119

* cited by examiner

POURING NOZZLE WITH A REPLACEABLE CROWN

REFERENCE TO RELATED APPLICATIONS

This application is a U.S. national stage application based on PCT/EP2018/061042 filed Apr. 30, 2018, claiming priority to German application no. 102017109448.2, filed May 3, 2017, the entire disclosures of which are incorporated herein by reference.

FIELD OF THE INVENTION

The present invention relates to a casting nozzle for a casting furnace and the casting furnace.

BACKGROUND

A casting nozzle and a casting furnace with the casting nozzle is known for example from the EP 0 215 153 A1.

It is object of the invention to improve the known casting nozzle.

The object is solved by the features of the independent claims. Preferred embodiments are subject of the dependent claims.

According to one aspect of the invention, a casting nozzle for guiding a melt from an outlet of a casting furnace into a casting box via a guiding channel comprises a main body and a crown that is attached onto the main body and through which both the guiding channel is led, wherein the main body includes a stub with a front side that is insertable into the outlet and into which the guiding channel enters, a flange joined to the stub on a site opposite to the front side for applying onto the casting furnace and a crown socket that is formed at the flange opposite to the stub for carrying the crown.

The provided casting nozzle is based on the problem that the melt must enter the casting chamber with a predefined fluidic dynamic to prevent the generation of casting defects, like shrinkage cavities or other inclusions and the reduction of the quality of the casting part to be produced. The casting nozzle should guarantee this fluidic dynamic. However, when passing the casting nozzle, the melt removes material in the area of the outlet of the guiding channel and modifies in that not only the geometric construction of the guiding channel, but leads also to the generation of the above mentioned inclusions in form of sand or air. Consequence of this wearing of the casting nozzle is that the predefined fluidic dynamic is not guaranteed anymore, the casting nozzle will be unusable and need thus to be exchanged.

To keep the operation expense for the exchange as low as possible, it is proposed to form the casting nozzle with two parts and to form the guiding channel in the area of the outlet into the casting chamber with the crown. Compared to the remaining part of the casting nozzle, the crown is clearly easier to manage and can be replaceabled in a more cost effective way, such that work time and costs can be saved with the provided casting nozzle.

To place the crown precisely on the crown socket, it can be supported on the crown socket in a form fitted way in which the crown is held at the crown socket by its shape and not by pressure, wherein the form fit prevents angular movement of the crown relative to the guiding channel.

To guarantee a sufficient position stability of the crown on the crown socket especially during the preparation measures of the casting, the crown can be adhered to the crown socket by a mounting adhesive. The mounting adhesive can be thermically decomposable, such that the crown can be removed from the crown socket after the casting process and, if applicable, exchanged, should this be necessary.

In a preferred embodiment of the casting nozzle, the material of the main body is different from the material of the crown. By that means, the characteristics of the casting nozzle can be changed locally, to adapt them in particular areas to the respective demand areas in an optimal way.

In a further embodiment, the provided casting nozzle comprises a brace that is placed around the boundary surface of the crown socket as well as the crown. Also in this way, position stability of the crown on the crown socket is ensured.

In a preferred embodiment, the provided casting nozzle comprises ventilation openings through the brace in an area in that the crown is carried on the crown socket. In this way, the above mentioned mounting adhesive can be securely drained of during the thermal decomposition within the casting process.

In another embodiment, the provided casting nozzle comprises a protrusion that is formed at the inner side of the brace and directed inwardly and that engages into the boundary surface of the crown. By that means, the brace can be easily fixed at the crown.

In a yet another embodiment of the provided casting nozzle, the protrusion is pressed into the brace. By that means, the bandage can be produced by simple blanking and stamping processes.

In a preferred embodiment, the provided casting nozzle comprises a carrying element for carrying the brace at the crown socket. By that means, the brace is fixedly supported a the remaining body of the casting nozzle, such that the single parts of the casting nozzle form a unit in particular together with the before mentioned protrusion.

In a particularly preferred embodiment of the casting nozzle, the carrying element is a pin that engages in a form fitted way into the brace as well as into the crown socket to prevent a relative movement of the bandage and the crown socket into the direction of the guiding channel. By that means, the carrying element can be easily mounted and released, such that the casting nozzle can be implemented and dismounted in a time saving way.

According to a further aspect of the invention, a casting furnace comprises a heatable furnace vessel with a chamber that can be filled with a melt via an inlet and that is loadable with pressure to press the melt via an outlet into a casting box and one of the before mentioned casting nozzles to connect the outlet with the casting box.

BRIEF DESCRIPTION OF THE FIGURES

The above described characteristics, features and advantages of this invention as well as the manner and way how they are achieved will get further comprehensive based on following description of the embodiments that will be explained in further detail in connection with the figures. It shows.

In the figures, equal technical elements will be provided with equal reference signs and described only one time. The figures are only of schematic nature and does in particular not disclose any real geometric dimension.

DETAILED DESCRIPTION OF PREFERRED EMBODIMENTS

Figure 1:
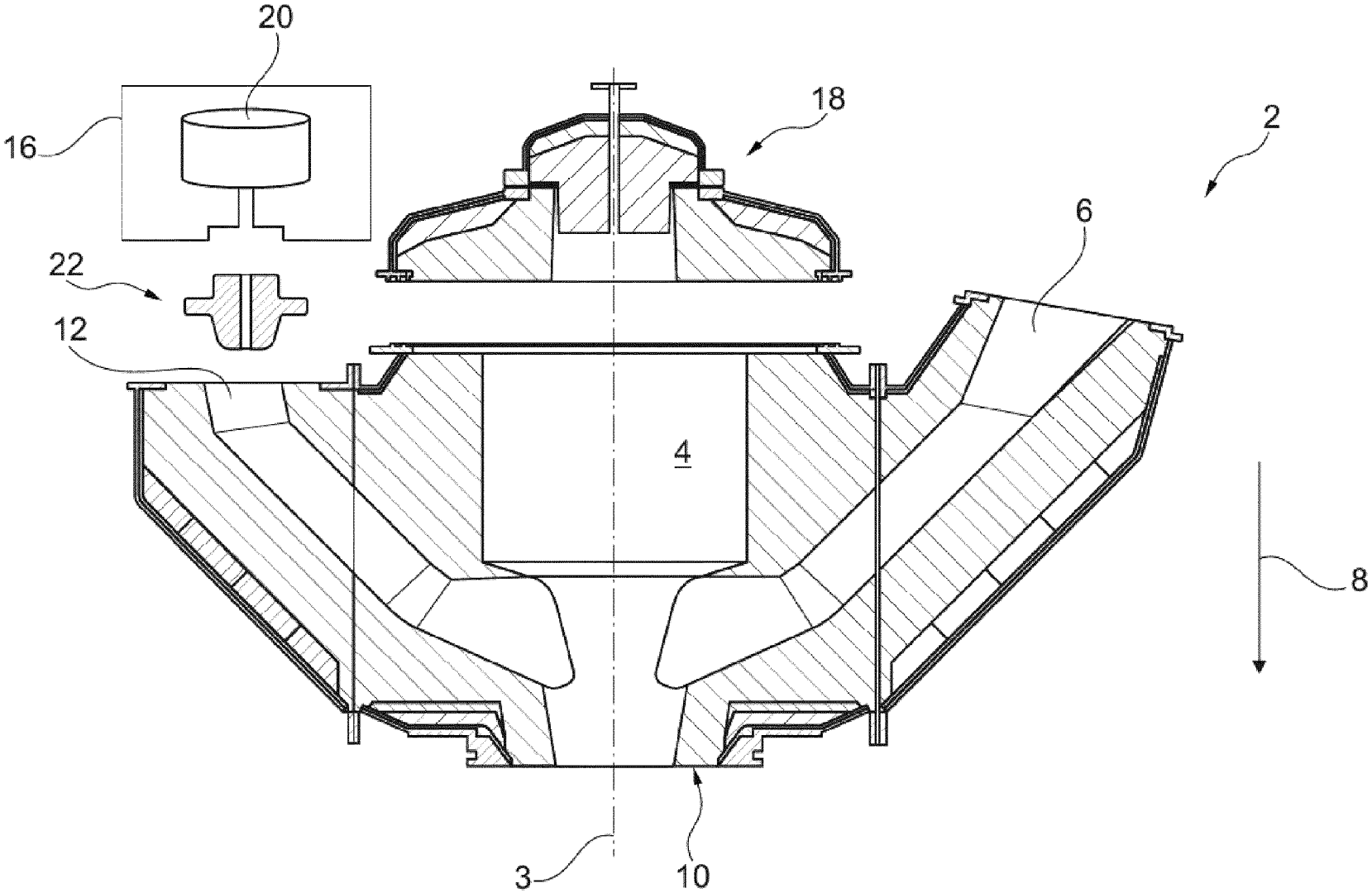
FIG. 1 a schematic exploded view of a section of a casting furnace.

Reference is made to FIG. 1 that shows a schematic exploded view of a section of a casting furnace 2.

The casting furnace 2 is basically known from the EP 0 215 153 A1 and a chamber 4 that is formed axially symmetrical around a rotation axis 3 for receiving a melt that is not further shown. The chamber 4 can be filled with the melt via an inlet 6. To prevent solidification of the melt in the chamber 4, die casting furnace 2 includes seen in a depth direction 8 at a bottom side a set up surface 10, via which the casting furnace 2 can be set up on a not further shown heating apparatus. Seen from the rotation axis 3, the casting furnace 2 includes opposite to the inlet 6 further an outlet 12, via which the melt in the chamber 4 can be provided into a casting box 16, which will be described later.

The casting furnace 2 is a low pressure casting furnace. In operation of the casting furnace 2, the chamber 4 will be added via a furnace cap 18 with a pressure that is known, for example from the EP 0 215 153 A1, such that the melt in the chamber 4 will be pressed via the outlet 12 into the casting box 16. After the melt is cooled down, a completed shaped piece 20 can be taken.

To produce the shaped piece with a predefined quality, predefined fluidic boundary conditions for the melt have to be given when leaving the outlet 12 and entering the casting box 16 to prevent casting defects, like air inclusions or other inclusions. To guarantee these fluidic boundary conditions, a casting nozzle 22 is inserted into the outlet that itself engages into the casting box 16. The casting nozzle 22 is geometrically constructed in that the before mentioned fluidic boundary conditions will be fulfilled.

Figure 3:
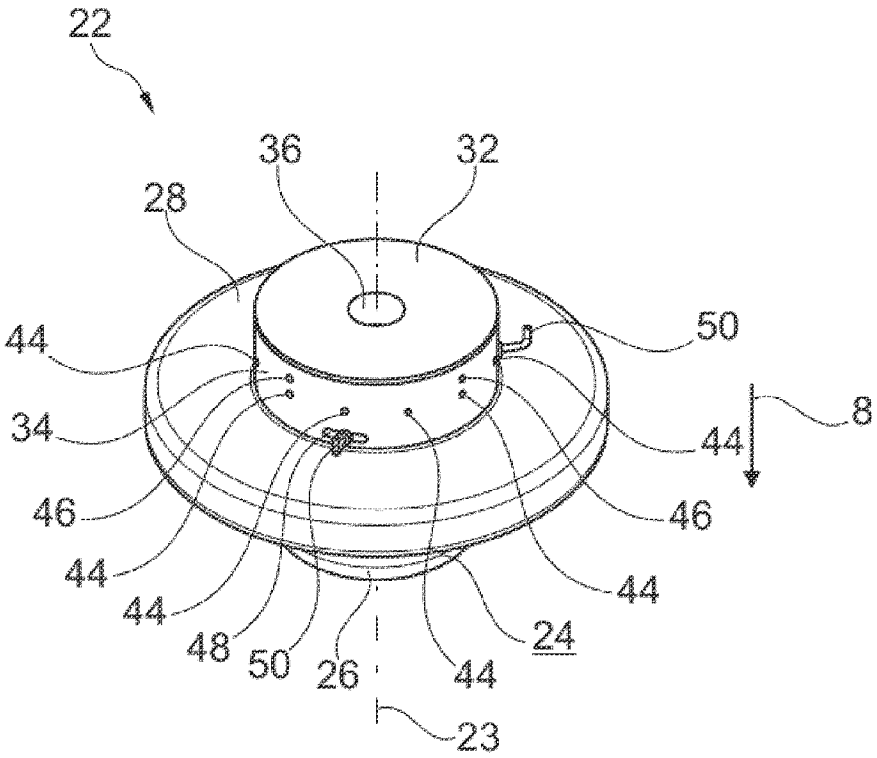

Hereinafter, the casting nozzle 22 will be described based on FIGS. 2 and 3.

The casting nozzle 22 is basically axially symmetrical around a further rotation axis 23 and includes a main body 24 with a stub 26 that is seen in the depth direction 8 arranged at the bottom side of the main body 24. At the top side of the stub 26, a flange 28 is joined, at which in turn a crown socket 30 is formed opposite to the side of the stub 26. On the crown socket 30 is carried as separated element a crown 32. The crown socket 30 and the crown 32 are surrounded by a brace 34, such that the crown socket 30 is not visible in the perspective view of FIG. 3.

Through the main body 24 and the crown 32, a guiding channel 36 extents in parallel to the depth direction 8 through which the melt can be guided out of the outlet 12 into the casting box 16 during the operation of the casting box 16. The flow path 38 of the melt is indicated in FIG. 2 by dashed arrows.

Figure 2:
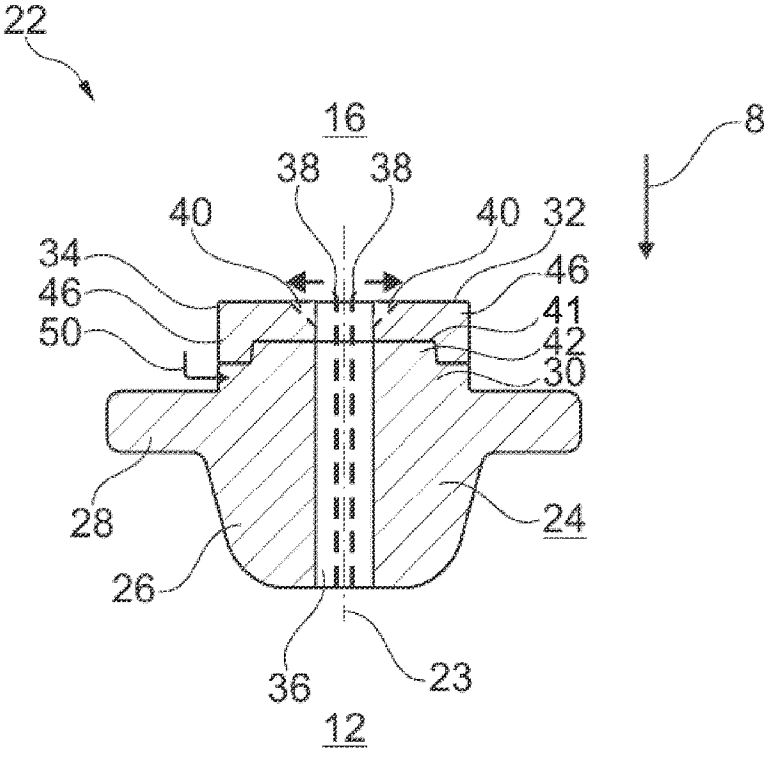
FIG. 2 a schematic view of a section of the casting nozzle of the casting furnace of FIG. 1, and FIG. 3 a schematic view of a perspective of the casting nozzle of the casting furnace.

As can be seen from the indication of the flow path 38 in FIG. 2, the melt removes material of the casting nozzle 22 when leaving the guiding channel 36 and changes its geometry in particular at the outlet from the guiding channel 36. This geometric changes are indicated in FIG. 2 by dashed triangles and referenced with reference signs 40.

However, the geometric changes 40 effect that the before mentioned fluidic boundary conditions for the entrance of the melt into the casting box 16 cannot be kept anymore. Respectively, the before mentioned casting defects should be expected, such that the casting nozzle 22 must be exchanged to guarantee the quality of the shaped piece 20.

However, in the present embodiment, a complete exchange of the casting nozzle 22 is necessary, because the crown 32 laying on the casting nozzle 22 can be easily removed and replaced by a new one. As in the nature of things, the crown 32 is significantly smaller compared with the complete casting nozzle 22 and can thus be exchanged by the operator within shortest time. Therein, not only machine downtime during normal operation can be prevented, the necessity for specialized operators to only install the crown 32 is not necessary, which is usually required to install the complete casting nozzle 22. A further advantage of the crown 32 that is separated from the remaining casting nozzle 22 can be seen therein that the crown can be replaced and adapted to different casting applications. Therein, it is possible to react on demand changes during the casting process in an easy way. For example, it is possible to individually react on chemical excavations and the like, when changing to steel cast.

Hereinafter, the fixation of the crown on the socket will be described in detail.

To guarantee a fixation of the crown 32 on the socket 30 independent of the brace 34, the crown 32 can include a recess 41 that extents against the depth direction 8 and in which a protrusion 42 on the socket 32 can engage in a form fitted way to prevent a movement of the crown 32 angular to the depth direction 8. Indeed, the recess 41 and the protrusion 42 can respectively also be arranged in an opposite way at the socket 30 and accordingly at the crown 32, however, the protrusion 42 brings additional weight into the crown 32 and makes it in case of an exchange unnecessarily heavy. Regarding this, the solution shown in FIG. 2 is optimal.

To further increase the fixation, the crown 32 can be adhered to the socket 30 by a mounting adhesive. This mounting adhesive should preferably be thermically decomposable, so that it re-disintegrates during the casting process, such that the crown 32 can be released from the socket 30 after the casting process. To enable the disintegrating mounting adhesive to escape from the brace 34 during the casting process, the brace 34 includes ventilation openings 44 that runs through its boundary surface. The ventilation openings 44 are arranged rotation symmetrical around the rotation axis 23 to enable as possible an equal drain of the mounting adhesive that disintegrates during the operation of the casting furnace 2.

To support the brace 34 as fix as possible at the crown 32 inwardly directed protrusions 46 can be pressed into the brace 34 seen in the depth direction 8 above the ventilation openings 44. The protrusions 46 enable to fixedly hold the brace 34 on the crown 32 during the installation of the crown 32 on the socket 30, such that the crown 32 can be installed and also deinstalled together with the brace 34.

For a secure position of the brace 34 on the socket 30, holding elements in form of pins 50 can be inserted into the socket 30 through long holes 48 in the brace 34. The long holes 48 allow to set the rotational position of the crown 32 on the socket 30 around the rotation axis 23. The pins 50 are further formed in a deflected form at their end, which projects from the socket 30 to provide the installer a good grip and to facilitate the installation.

The invention claimed is:

1. A casting nozzle for guiding a melt from an outlet of a casting furnace into a casting box, the casting nozzle comprising:

a main body;

a crown attached to the main body;

a guiding channel through the main body and the crown;

a stub on the main body, which stub has a front side that is insertable into a casting furnace outlet and into which the guiding channel enters;

a flange on the stub on a side opposite to the front side for applying onto the casting furnace; and a crown socket that is formed at the flange opposite to the stub for carrying the crown, wherein the crown is supported on the crown socket in a form fitted way to prevent angular movement of the crown relative to the guiding channel.

2. The casting nozzle of claim 1, wherein the crown is adhered to the crown socket by a mounting adhesive, that is thermically decomposable.

3. The casting nozzle according to claim 1, comprising a brace that is placed around a boundary surface between the crown socket and the crown.

4. The casting nozzle according to claim 3, comprising ventilation openings through the brace in an area where the crown is carried on the crown socket.

5. The casting nozzle according to claim 3, comprising a protrusion that is formed at an inner side of the brace and directed inwardly and that engages into the crown.

6. The casting nozzle according to claim 5, wherein the protrusion is pressed into the crown.

7. The casting nozzle according to claim 3 comprising a carrying element for carrying the brace at the crown socket.

8. The casting nozzle according to claim 7, wherein the carrying element is a pin that engages in a form fitted way into the brace as well as into the crown socket to prevent a relative movement of the brace and the crown socket in the direction of the guiding channel.

9. A casting furnace comprising a heatable furnace vessel with a chamber that can be filled with a melt via an inlet and that is loadable with pressure to press the melt via an outlet into a casting box and a casting nozzle according claim 1 to connect the outlet with the casting box.

10. The casting nozzle according to claim 1 in combination with a casting furnace comprising a heatable furnace vessel with a chamber that can be filled with a melt via an inlet and that is loadable with pressure to press the melt via an outlet into a casting box, wherein the casting nozzle connects the outlet to the casting box.

11. The casting nozzle of claim 1, wherein the crown is adhered to the crown socket by a mounting adhesive, that is thermically decomposable.

12. The casting nozzle according to claim 1, comprising:

a brace around a boundary surface between the crown socket and the crown;

ventilation openings through the brace in an area where the crown is carried on the crown socket;

a protrusion at the inner side of the brace and directed inwardly and that engages into the crown, wherein the protrusion is pressed into the crown; and a carrying element for carrying the brace at the crown socket.

13. The casting nozzle according to claim 2, comprising:

a brace around a boundary surface between the crown socket and the crown;

ventilation openings through the brace in an area where the crown is carried on the crown socket;

a protrusion at the inner side of the brace and directed inwardly and that engages into the crown, wherein the protrusion is pressed into the crown.

14. The casting nozzle according to claim 2, comprising:

a brace around a boundary surface between the crown socket and the crown;

ventilation openings through the brace in an area where the crown is carried on the crown socket;

a protrusion at the inner side of the brace and directed inwardly and that engages into the crown, wherein the protrusion is pressed into the crown; and a carrying element for carrying the brace at the crown socket.

15. A casting nozzle for guiding a melt from an outlet of a casting furnace into a casting box, the casting nozzle comprising:

a main body;

a crown attached to the main body;

a guiding channel through the main body and the crown;

a stub on the main body, which stub has a front side that is insertable into a casting furnace outlet and into which the guiding channel enters;

a flange on the stub on a side opposite to the front side for applying onto the casting furnace;

a crown socket that is formed at the flange opposite to the stub for carrying the crown;

a brace that is placed around a boundary surface between the crown socket and the crown; and ventilation openings through the brace in an area where the crown is carried on the crown socket.

16. A casting nozzle for guiding a melt from an outlet of a casting furnace into a casting box, the casting nozzle comprising:

a main body;

a crown attached to the main body;

a guiding channel through the main body and the crown;

a stub on the main body, which stub has a front side that is insertable into a casting furnace outlet and into which the guiding channel enters;

a flange on the stub on a side opposite to the front side for applying onto the casting furnace;

a crown socket that is formed at the flange opposite to the stub for carrying the crown;

a brace that is placed around a boundary surface between the crown socket and the crown; and a protrusion that is formed at the inner side of the brace and directed inwardly and that engages into the crown.

* * * * *